US007007749B2

(12) United States Patent
Brost et al.

(10) Patent No.: US 7,007,749 B2
(45) Date of Patent: Mar. 7, 2006

(54) HOUSING-LESS PLATE HEAT EXCHANGER

(75) Inventors: Viktor Brost, Aichtal (DE); Rainer Kasinger, Hsiterbach (DE)

(73) Assignee: Modine Manufacturing Company, Racine, WI (US)

( * ) Notice: Subject to any disclaimer, the term of this patent is extended or adjusted under 35 U.S.C. 154(b) by 14 days.

(21) Appl. No.: 10/280,338

(22) Filed: Oct. 24, 2002

(65) Prior Publication Data

US 2003/0106679 A1 Jun. 12, 2003

(30) Foreign Application Priority Data

Oct. 24, 2001 (DE) ..... 101 52 363

(51) Int. Cl.
*F28F 3/02* (2006.01)

(52) U.S. Cl. ..... 165/167; 165/178; 165/916

(58) Field of Classification Search ..... 165/167, 165/916, 153, 178
See application file for complete search history.

(56) References Cited

U.S. PATENT DOCUMENTS 1,754,857 A * 4/1930 Harrison ..... 165/70
2,248,933 A * 7/1941 Astle ..... 165/167
2,610,834 A * 9/1952 Dalzell ..... 165/167
2,639,126 A * 5/1953 Newhall ..... 165/167
4,373,579 A * 2/1983 Jernqvist et al. ..... 165/167
4,708,199 A * 11/1987 Yogo et al. ..... 165/167
4,742,866 A * 5/1988 Yamanaka et al. ..... 165/167
4,821,531 A * 4/1989 Yamauchi et al. ..... 165/153
4,987,955 A * 1/1991 Bergqvist et al. ..... 165/167
5,099,912 A * 3/1992 Tajima et al. ..... 165/167
5,355,947 A * 10/1994 Rasso et al. ..... 165/153
5,464,056 A * 11/1995 Tajima et al. ..... 165/167
5,954,126 A * 9/1999 Armbruster ..... 165/167
6,173,764 B1 * 1/2001 Inoue ..... 165/153
6,520,251 B1 * 2/2003 Shin et al. ..... 165/153

FOREIGN PATENT DOCUMENTS

DE 3102314 A1 12/1981
JP 02225954 A * 9/1990 ..... 62/515
WO WO 99/51926 10/1999

* cited by examiner

*Primary Examiner*—Leonard R. Leo
(74) *Attorney, Agent, or Firm*—Wood, Phillips, Katz, Clark & Mortimer

(57) ABSTRACT

A housing-less plate heat exchanger is provided for transferring heat between at least a first fluid and a second fluid. The heat exchanger includes a plurality of heat exchange plates stacked to enclose flow channels for the first and second fluids between the plates, a first intermediate plate pair sandwiched between a first and second stack of the heat exchange plates, and a barrier located between the plates of the intermediate plate pair to separate the first fluid from the second fluid. The intermediate plate pair includes a first fluid port extending laterally from the heat exchanger to transfer the first fluid between the heat exchanger and a device other than the heat exchanger. The intermediate plates are joined to enclose a first chamber, with the first chamber opening to the first fluid port and to a manifold for the first fluid to direct the first fluid between the first fluid port and the manifold.

5 Claims, 11 Drawing Sheets

HOUSING-LESS PLATE HEAT EXCHANGER

RELATED APPLICATIONS

This application claims priority under 35 U.S.C. §119 to German application DE 101 52 363.7 filed Oct. 24, 2001, the entire contents of which are incorporated herein by reference.

FIELD OF THE INVENTION

This invention is directed towards heat exchangers, and more particularly, toward housing-less plate heat exchangers wherein at least one inlet or outlet emerges laterally from the heat exchanger.

BACKGROUND OF THE INVENTION

Housing-less plate heat exchangers are known that include a nested stack of heat exchange plates that define flow channels between the plates for the transfer of heat between first and second fluids flowing through the channels, with aligned openings in each of the plates defining inlet and outlet manifolds for the respective first and second fluids to distribute and collect the first and second fluids from the flow channels. Such heat exchangers are often used as oil coolers for vehicular engines or other machines. Typically, such heat exchangers include inlet ports and outlet ports located on the ends of the heat exchangers. However, some housing-less plate heat exchangers include inlet and outlet ports that emerge laterally from the heat exchanger. An example of such a construction is shown in International Patent Application WO 99/51926 wherein an inlet port and outlet port emerge laterally from an intermediate plate arranged between the nested stack of heat exchange plates. The disclosed heat exchanger is intended for heat exchange between three media and consists of two separate plate heat exchangers connected by the intermediate plate on which the lateral connections are arranged. The intermediate plate has a number of openings for the passage of various fluids, and its extent corresponds to the extent of the nested heat exchange plates and cover plates. The diameter of the connections for the inlet and outlet ports determines the thickness of the intermediate plate, so that a relatively thick intermediate plate is be present at large diameters.

An intermediate plate fitting for heat exchangers is also known from German patent document DE 31 02 314 C2, which does not however belong to the housing-less design. Rather, the construction is that of a coolant radiator that is provided with cooling fins for a cooling air stream flow. The construction does provide for inlet or outlet ports that emerge laterally from a plate type heat exchanger, but that require a two-part intermediate plate fittings to accommodate the corresponding intermediate plate fitting. These intermediate plates require that the adjacent heat exchange plates be modified so that they are configured differently then the other heat exchange plates in the construction. This can require an additional dye and an associated increase in terms of the logistic requirements associated with an increase in the number of different parts for the construction.

SUMMARY OF THE INVENTION

A housing-less plate heat exchanger is provided for transferring heat between at least a first fluid and a second fluid. The housing-less plate heat exchanger includes a first inlet manifold that distribute the first fluid, a first outlet manifold to collect the first fluid, a second inlet manifold to distribute the second fluid, and a second outlet manifold to collect the second fluid. The heat exchanger further includes a plurality of heat exchange plates stacked to enclose flow channels for the first and second fluids between the plates, a first intermediate plate pair sandwiched between a first and second stack of the heat exchange plates, and a barrier located between the plates of the intermediate plate pair to separate the first fluid from the second fluid. Each of the heat exchange plates includes a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define a second outlet manifold. The first intermediate plate pair includes a first fluid port extending laterally from the heat exchanger to transfer the first fluid between the heat exchanger and a device other than the heat exchanger. Each plate of the intermediate plate pair includes a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold. The intermediate plates are joined to enclose a first chamber. The first chamber opens to the first fluid port and to one of the first fluid inlet and outlet manifolds to direct the first fluid between the first fluid port and the one of the first fluid inlet and outlet manifolds.

In one form, the barrier includes embossed features formed on the intermediate plates.

In one form, each heat exchange plate located adjacent the intermediate plate pair has a surface facing the intermediate plate pair, and each plate of the intermediate plate pair extends substantially over the entire facing surface of the adjacent heat exchange plate.

According to one form, the intermediate plate pair further includes a second fluid port extending laterally from the heat exchanger to transfer the first fluid between the heat exchanger and a device other than the heat exchanger. The intermediate plates enclose a second chamber, with the second chamber opening to the second fluid port and to the other of the first fluid inlet and outlet manifolds to direct the first fluid between the second fluid port and the other of the first fluid inlet and outlet manifolds. The first and second chambers are separated by a barrier to restrict the flow of the first fluid between the first and second chambers.

According to one form, the housing-less plate heat exchanger further includes a second intermediate plate pair located at a opposite end of one of the first and second stacks of the heat exchanger plates from the first intermediate plate pair. The second intermediate plate pair includes a second fluid port extending laterally from the heat exchanger to transfer the first fluid between the heat exchanger and a device other than the heat exchanger. Each plate of the second intermediate plate pair includes a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold. The second intermediate plates are joined to enclose a second chamber, with the second chamber opening to the second fluid port and to the other of the first fluid inlet and outlet manifolds to direct the first fluid between the second fluid port and the other of the first inlet and outlet manifolds. The housing-less plate heat exchanger further includes a second barrier located between the second intermediate plates to separate the first fluid from the second fluid.

In one form, the intermediate plates are mirror images of each other.

In one form, the intermediate plates are identical.

According to one form, the intermediate plates enclose an additional chamber that is separated from the first chamber by an additional barrier, and the additional barrier includes interruptions to allow a restricted flow of the first fluid between the first chamber and the additional chamber.

In one form, each of the intermediate plates includes a laterally extending semi-cylindrical feature that mates with the laterally extending semi-cylindrical feature of the other intermediate plate to form a cylindrical shape for the first inlet port.

According to one form, each of the heat exchange plates and each of the intermediate plates includes an additional opening, with the additional openings being aligned to provide a through hole in the heat exchanger.

In one form, each of the heat exchange plates has a continuous outer rim that can be nested in the continuous outer rim of an adjacent heat exchange plate, with the rims of each of the first and second stacks turned away from the intermediate plate pair.

In one form, the heat exchange plates and the intermediate plates are joined by soldering.

Other objects and advantages of the invention will become apparent after reviewing the entire disclosure, including the appended claims and drawings.

DETAIL DESCRIPTION OF THE PREFERRED EMBODIMENTS

With reference to FIGS. 1–5, the invention is described herein in connection with a heat exchanger 10 that serves as an oil cooler for a machine, which would typically be an engine for a vehicle. However, it should be understood that the invention may be used with other forms of heat exchangers that transfer heat between at least a first and a second fluid and accordingly is not limited to use as an oil cooler unless expressly so stated in the claims.

Figure 1:
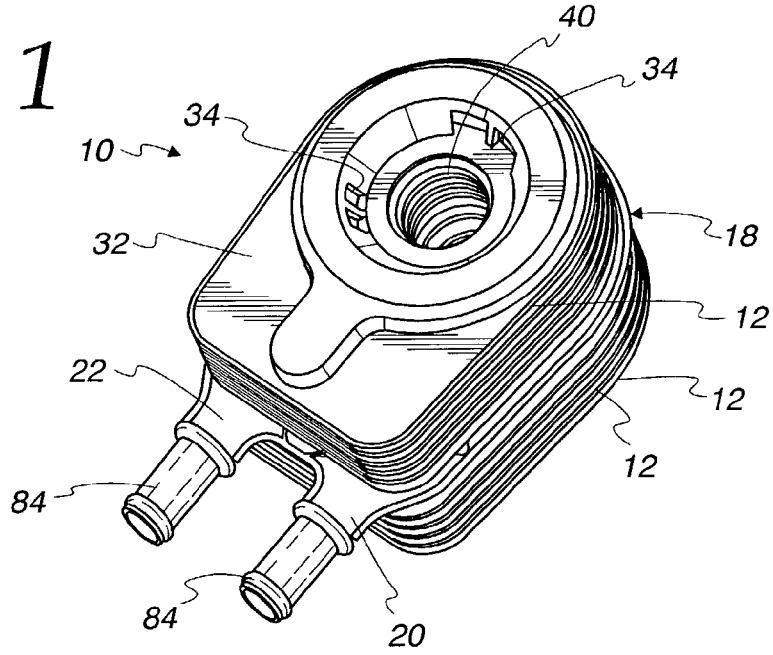
FIG. 1 is a prospective view of a housing-less plate heat exchanger embodying the present invention.
Figure 2:
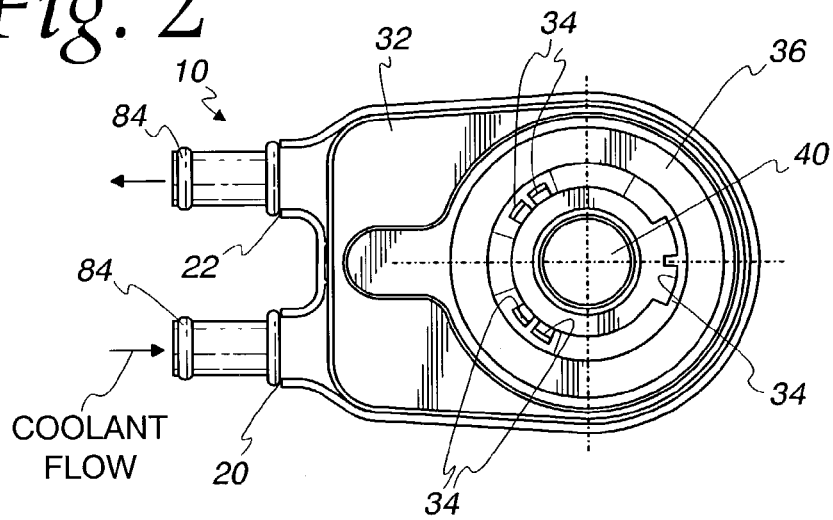
FIG. 2 is a top view of the heat exchanger of FIG. 1.
Figure 3:
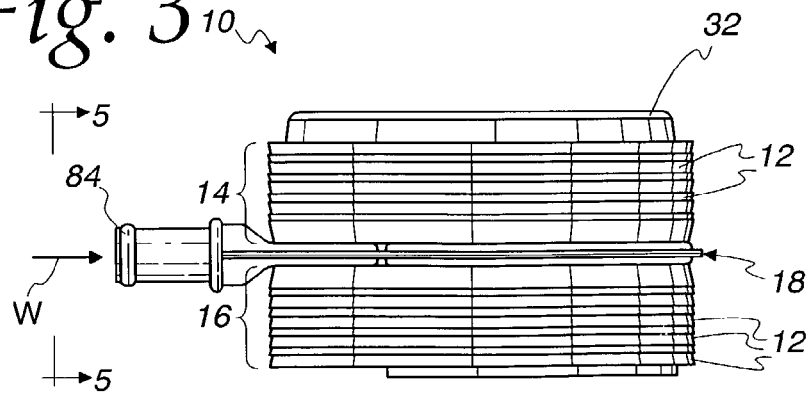
FIG. 3 is a side elevation of the heat exchanger of FIG. 1.

The heat exchanger 10 includes a plurality of trough shaped heat exchange plates 12 arranged in first and second nested stacks 14 and 16 on either side of an intermediate plate pair 18, as best seen in FIG. 3. The intermediate plate pair 18 includes a laterally extending inlet port 20 and a laterally extending outlet port 22 for directing a first fluid in the form of a coolant into and out of the heat exchanger 10, as best seen in FIGS. 1 and 2.

Figure 4:
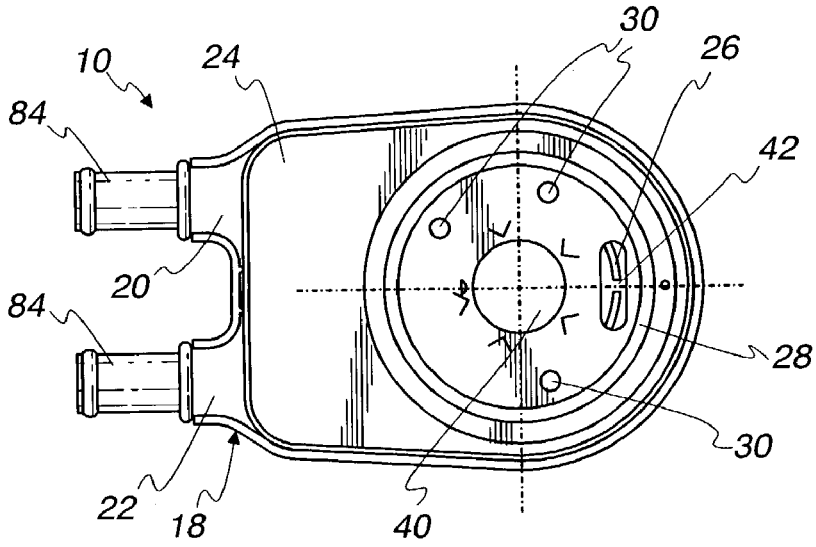
FIG. 4 is a bottom view of the heat exchanger of FIG. 1.
Figure 5:
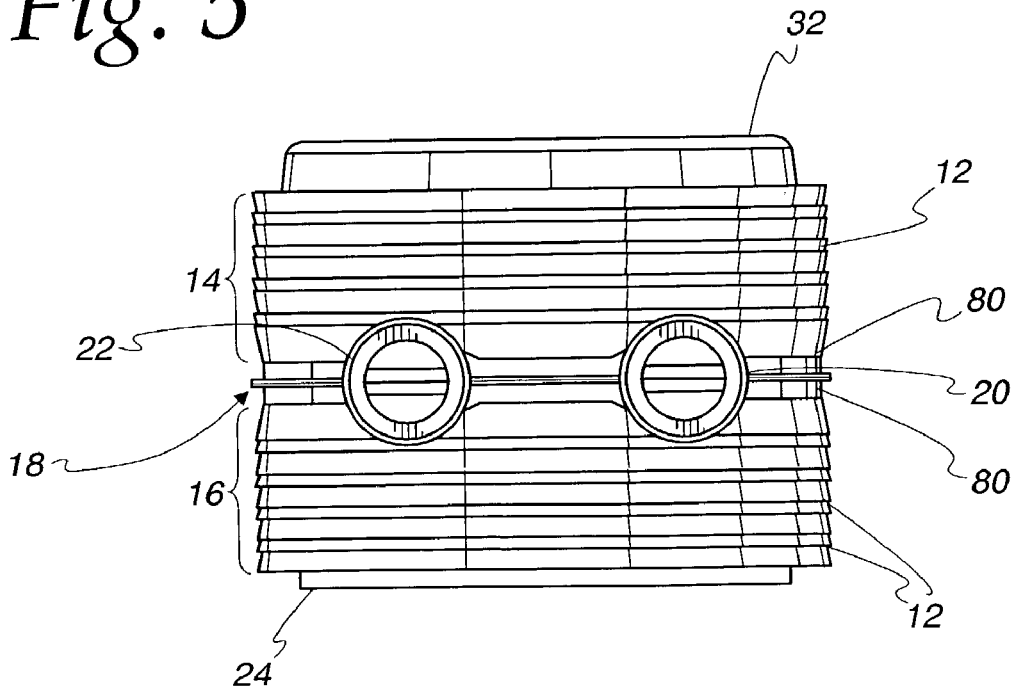
FIG. 5 is a view taken from line 5—5 in FIG. 3.

As best seen in FIG. 4, a gasket plate 24 is provided on the stack 16 and includes an oblong inlet port 26 for a second fluid in the form of oil, a gasket 28 to seal the heat exchanger 10 to the associated machine (not shown) and, optionally, fastening holes 30 to connect the heat exchanger 10 to the machine. As best seen in FIGS. 1 and 2, the heat exchanger also includes an upper baffle plate 32 located on the top of the stack 14. The baffle plate 32 includes a multi-opening outlet port 34 surrounded by a gasket mating surface 36 that mates with the gasket on an oil cooler or manifold dome. As best seen in FIGS. 1, 2 and 4, the heat exchanger 10 also includes a centrally located through hole 40 that in the illustrated embodiment serves as an oil return flow path to the machine to which the heat exchanger 10 is attached. It should be understood that the configuration shown in FIGS. 1–5 is for purposes of illustration and other practical examples (not shown) are possible. For example, the provision of the central through hole 40 may not be required in all applications, or if provided may be arranged off-center, rather than centrally. By way of further example, the first and second stacks 14 and 16 of the heat exchange plates 12 have a equal number of heat exchange plates 12 so that the intermediate plate pair 18 is arranged precisely in the center of the combined stack of the plates 12. However, this may not be necessary or desired in all cases, with some applications potentially requiring that the intermediate plate pair 18 be arranged off-center with an unequal number of heat exchange plates 12 in the first and second stacks 14 and 16. By way of further example the heat exchanger 10 illustrated in FIGS. 1–5 has a roughly rectangular external shape which may not be desirable in all applications. For example, in some applications it may be more desirable for the heat exchanger 10 to have a substantial cylindrical shape.

Having described the general features of the heat exchanger 10, the detailed features of the heat exchanger 10 will now be discussed with reference to FIGS. 6–9. As best seen in FIG. 7, the oil enters the heat exchanger 10 through the inlet port 26 and is directed into a vertically extending oil inlet manifold 42 that is defined by aligned openings 44 provided in each of the heat exchange plates 12. The inlet manifold 42 distributes the oil to a plurality of flow channels 46 defined between the plates 12, as shown by the arrows in FIG. 7. It should be noted that a turbulator (not shown) or other flow enhancement may be provided in each of the flow channels 46 to enhance the heat transfer from the oil, as is known. The oil passes through the channels 46 and is then collected in a vertically extending oil outlet manifold 48 defined by a plurality of aligned openings 50 provided in each of the heat exchange plates 12. As is known, embossed flanges or edges surrounding each of the openings 44 and 50 in each of the plates 12 and are abutted and bonded using suitable bonding technique to seal the respective manifolds 42, 48. Again as shown by the arrows in FIG. 7, the oil then exits the heat exchanger 10 through the outlet port 34 so that it may flow through an oil filter (not shown) and then back down to the machine via the through hole 40, which is defined by a series of aligned openings 52 provided in each of the plates 12 with each of the holes 52 being surrounded by a continuous rim 54 that is nested with the continuous rim 44 of an adjacent heat exchange plate 12 and bonded thereto to seal the through hole 40 with respect to the rest of the heat exchanger 10.

Figure 6:
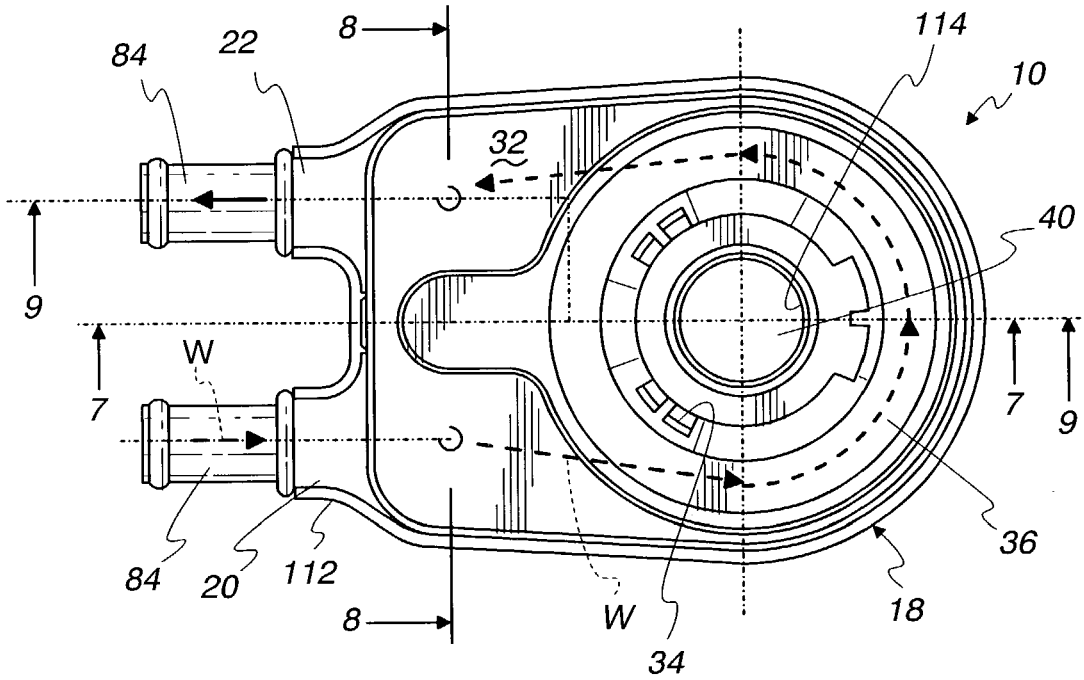
FIG. 6 is an enlarged top view similar to FIG. 2.
Figure 7:
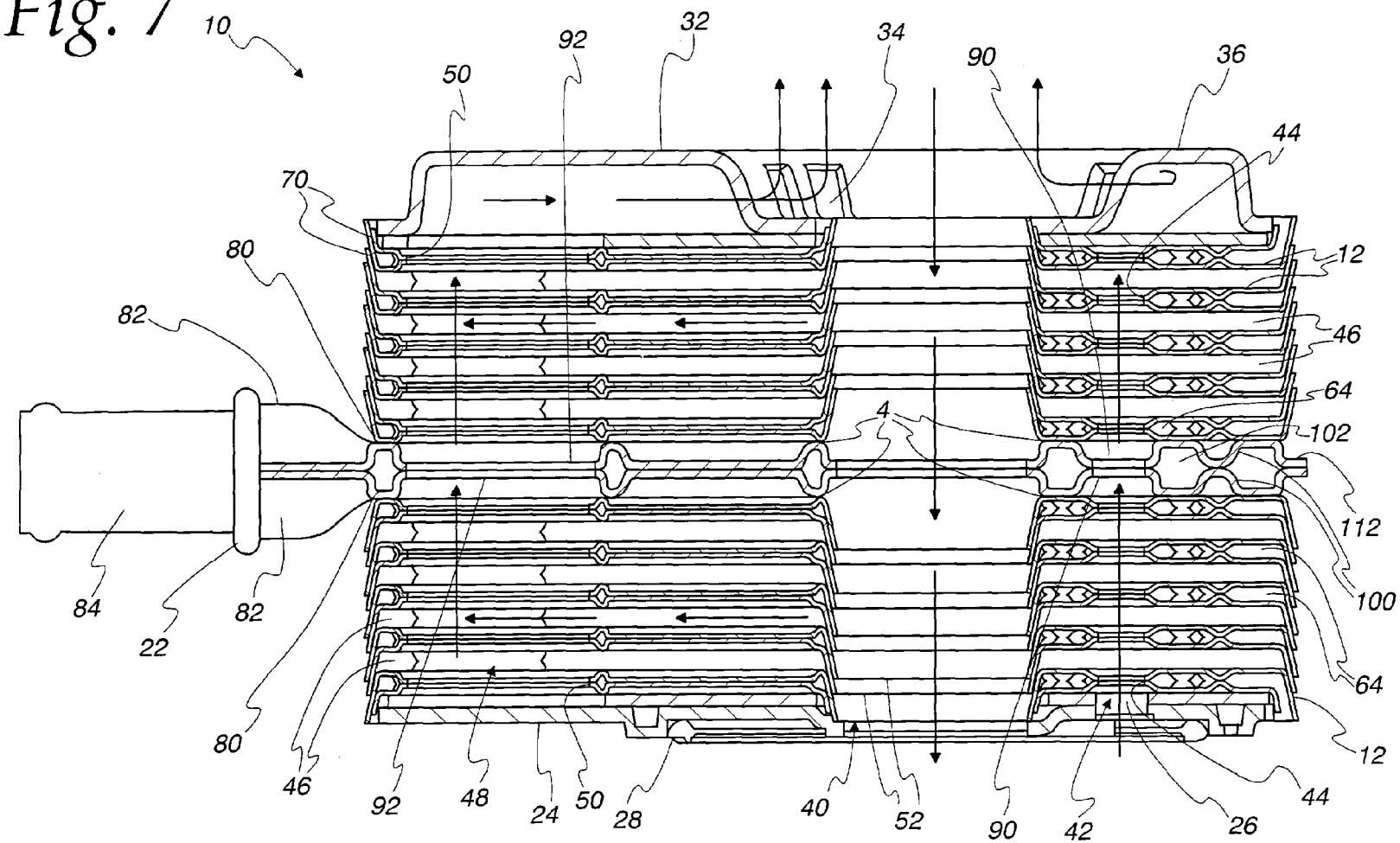
FIG. 7 is a view taken from line 7—7 in FIG. 6.
Figure 8:
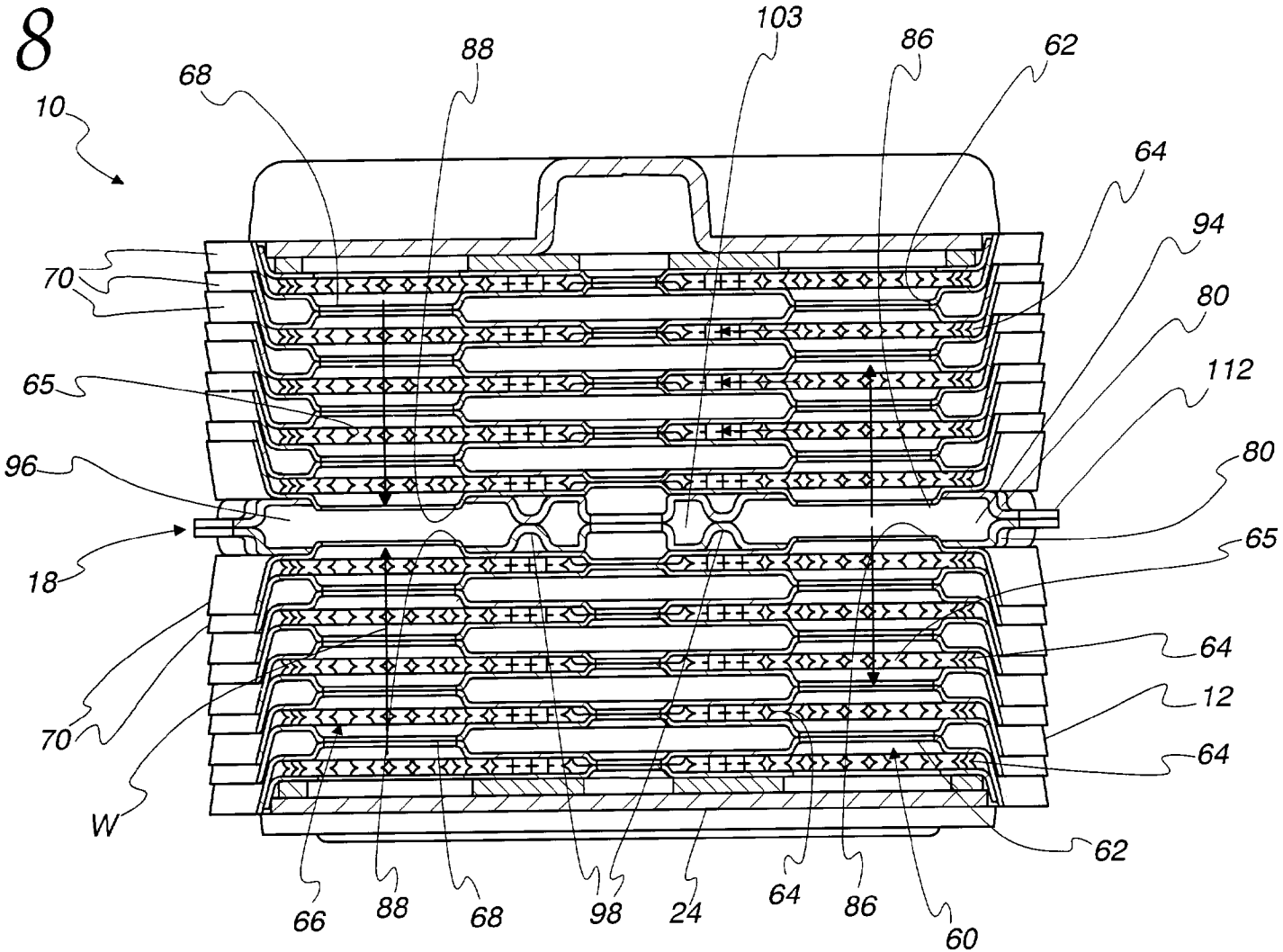
FIG. 8 is a view taken from line 8—8 in FIG. 6.
Figure 9:
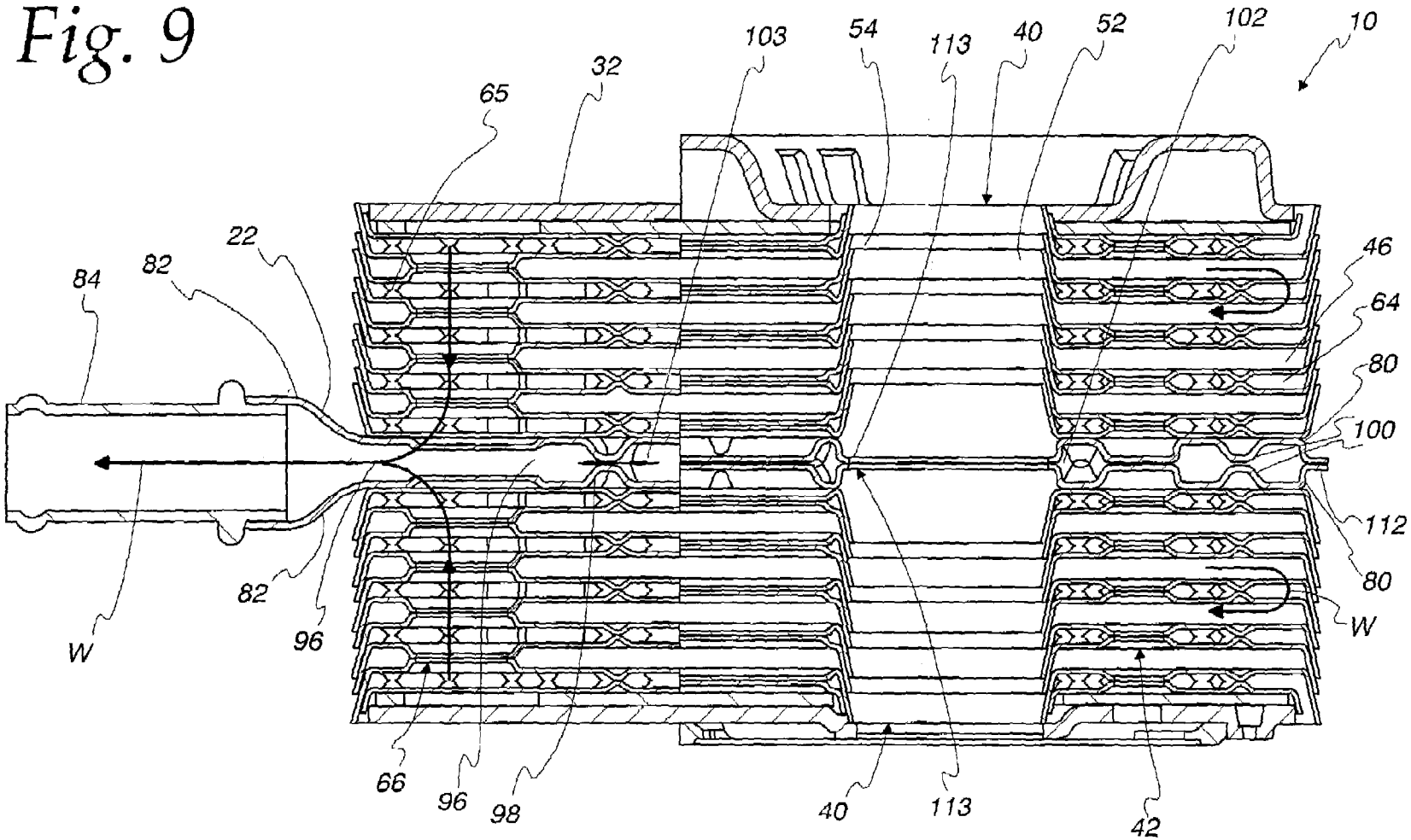
FIG. 9 is a view taken from line 9—9 in FIG. 6.

The arrows in FIGS. 6, 8, and 9 are intended to illustrate the coolant flow through the heat exchanger 10 and it should be understood that the arrows on the right side of FIG. 9 are situated in the oil flow channels 46 merely for reasons of illustration. As best seen in FIGS. 8 and 9, after the coolant has entered the heat exchanger 10 via the inlet port 20 and the intermediate plate pair 18, it is directed in diverging directions to a vertically extending coolant inlet manifold 60 that is defined by a plurality of aligned openings 62 provided in each of the heat exchange plates 12, as shown by the arrows. The coolant inlet manifold 60 distributes the coolant to a plurality of coolant flow channels 64 enclosed between the heat exchange plates 12. It should be noted that in the illustrated embodiment, the oil flow channels 46 are taller than the coolant flow channel 64 as is typical in oil coolers. The flow channels 64 are provided with support knobs 65 embossed in each of the heat exchange plates 12 and bonded to the knobs 65 of an adjacent plate 12. The knobs 65 increase the stability of the heat exchanger and contribute to creation of turbulence on the coolant side. This type of configuration also belongs to the prior art. The coolant flow through the channels 64 is then collected in a vertically extending coolant outlet manifold 66 defined by a plurality of aligned openings 68 provided in each of the heat exchange plates 12 and is directed in converging directions by the outlet manifold 66 back to the intermediate plate pair 18, as shown by the arrows. As is known, embossed flanges or edges surround the openings 62 and 68 in each of the plates 12 and are abutted and bonded using a suitable bonding technique to seal the respective manifolds 60, 66.

As best seen in FIG. 6, each of the heat exchange plates 12 includes a continuous rim 70 that can be nested in the continuous rim 70 of an adjacent heat exchange plate 12 and bonded thereto so as to seal the flow channels 46 and 64. In this regard, as best seen in FIGS. 3, 5, and 7–9, the heat exchange plates 12 are arranged so that the rims 70 turn away fro the intermediate plate pair 18. This allows the intermediate plate pair 18 to be connected directly to the adjacent heat exchange plates 12 on either side, since the essentially flat bottom of each of the heat exchange plates 12 lies directly on the essentially flat surfaces of the intermediate plate pair 18.

The intermediate plate pair 18 includes a pair of mating plates 80 which are mirror images of each other and identical. Preferably, each of the plates 80 include a pair of laterally extending, semi-cylindrical features 82, with each semi-cylindrical feature 82 mating with one of the semi-cylindrical features 82 of the other intermediate plate 80 to form a cylindrical shape for one of the ports 20 and 22. This allows the ports 20 and 22 to accept a cylindrical connector 84 in the form of a standard hose connector. Preferably, the features 82 are formed by deformation of the plates 80. This allows for the inlet and outlet ports 20, 22 to have a larger diameter without requiring an increase thickness of the intermediate plate pair 18. It is preferred that the plates 80 be made from aluminum sheets of relatively limited sheet thickness so as to minimize the weight of the heat exchanger 10.

Figure 10:
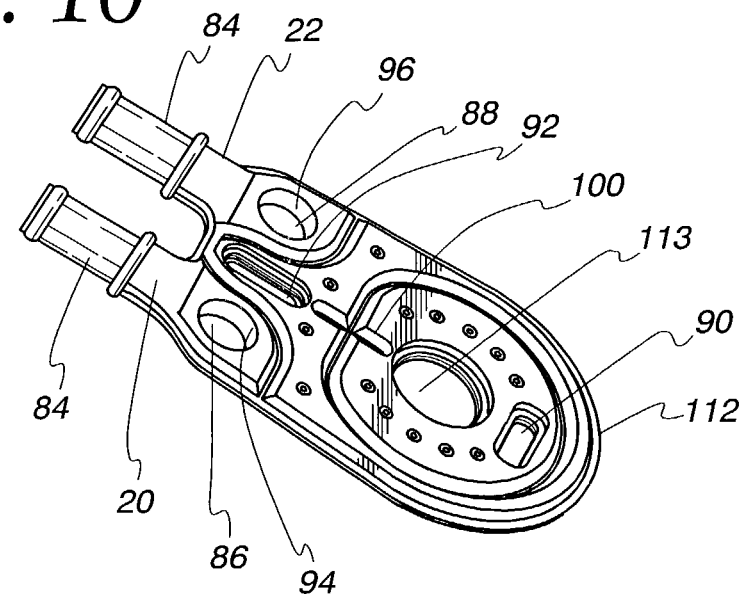
FIG. 10 is a perspective view of an intermediate plate pair of the heat exchanger of FIG. 1.
Figure 11:
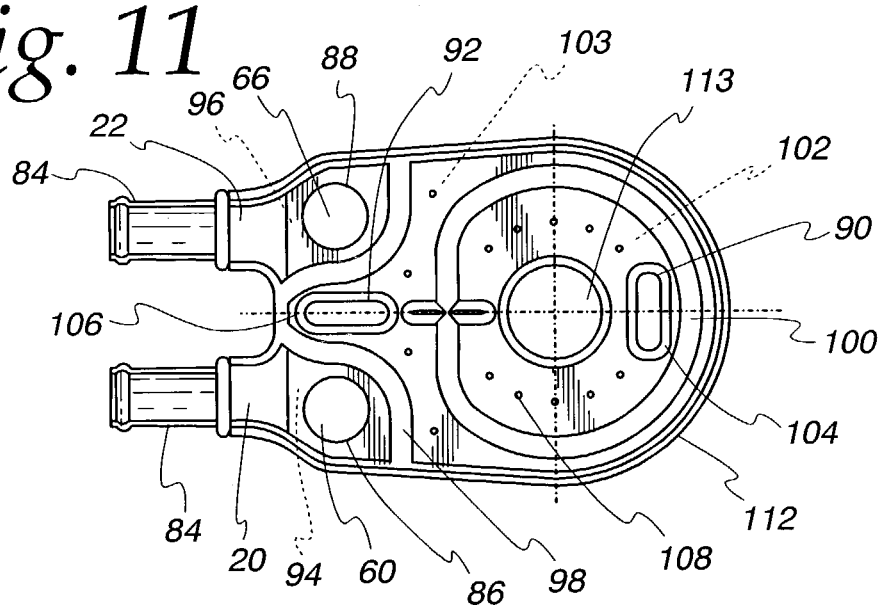
FIG. 11 is a top view of the intermediate plate pair of FIG. 10.
Figure 12:
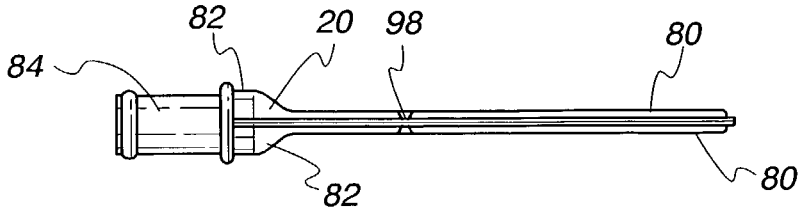
FIG. 12 is a side view of the intermediate plate pair of FIG. 10.
Figure 13:
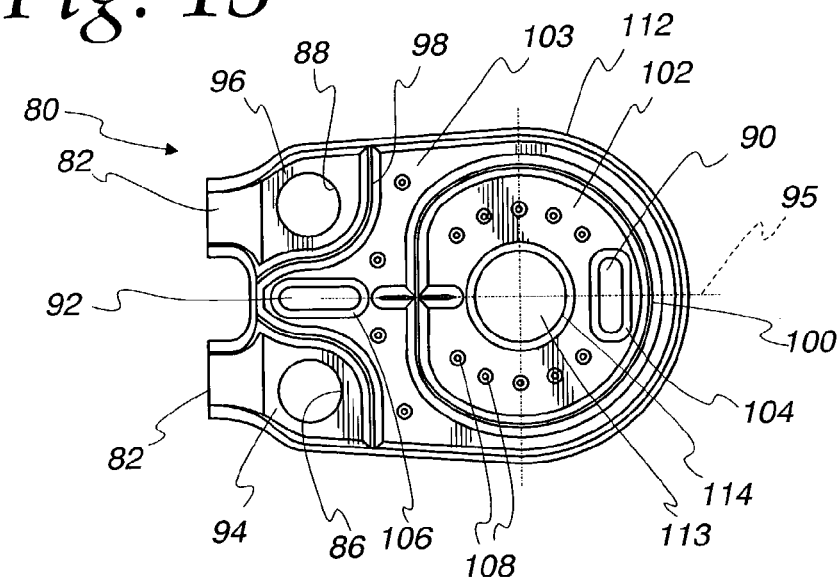
FIG. 13 is a view of the interior side of one of the plates of the intermediate plate pair of FIG. 10.
Figure 14:
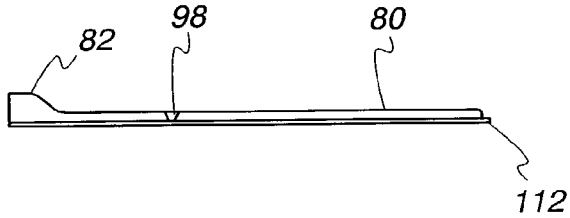
FIG. 14 is a side view of one of the plates of the intermediate plate pair of FIG. 10.

As best seen in FIGS. 8 and 10, each of the intermediate plates 80 includes an opening 86 that is aligned with an opening 62 of an adjacent heat exchange plate 12 to define the coolant inlet manifold 60, and an opening 88 that is aligned with an opening 68 of an adjacent heat exchange plate 12 to define the coolant outlet manifold 66. Further, as best seen in FIGS. 7 and 10, each of the intermediate plates 80 include an opening 90 that is aligned with an opening 44 of an adjacent heat exchange plate 12 to define the oil inlet manifold 42, and an opening 92 that is aligned with an opening 50 of an adjacent heat exchange plate 12 to define the oil outlet manifold 48. As best seen in FIGS. 8 and 10, the intermediate plates 80 are joined to enclose a pair of chambers 94 and 96, with the chamber 94 opening to the coolant inlet port 20 and to the coolant inlet manifold 60 to direct the coolant therebetween, and the chamber 96 opening to the coolant outlet manifold 66 and the coolant outlet port 22 to direct the coolant therebetween. As best seen in FIGS. 10–14, embossed beads 98 are provided on each of the intermediate plates 80 and abut and are bonded to the beads 98 on the other plate 80 to serve as barriers to prevent or restrict coolant from flowing between the chambers 94 and 96. Additionally, an embossed stiffening bead 100 is provided in each of the intermediate plates 18 and abuts and is bonded to the bead 100 in the other intermediate plate 18 to define another chamber 102 between the plates 18 and to serve as a barrier that restricts or prevents the flow of coolant into the chamber 102 or the flow of oil out of the chamber 102. The embossed beads 98 and 100 cooperate to define yet another chamber 103 between the beads 98 and 100, with the bead 98 serving as a barrier to restrict or prevent the flow of coolant into the chamber of 103 and the bead 100 serving as a barrier that restricts or prevents the flow of oil into the chamber 103.

Additionally, each of the openings 90 and 92 is surrounded by an embossed, continuous edge or flange 104 and 106, respectively that abut the flange 104 and 106, respectively, on the opposite intermediate plate 80 to block or restrict the flow of oil from the manifolds 42 and 48 into the space enclosed between the intermediate plates 80, i.e. the chambers 94, 96, 102, and 103. It should be appreciated that any one of the beads 98,100 or continuous edges 104, 106 can serve as a barrier that is located between the plates 80 to separate the coolant from the oil if one or more of the other features 98, 100, 104, 106 are not provided. In this regard, one example of a possible modification is that the continuous edges 104 and 106 could be completely eliminated from the plates 80. In such a construction it would be apparent from reviewing FIGS. 10 and 12 that the chamber 102 enclosed by the bead 100 would be occupied with the inflowing oil and the space 103 between the beads 98 and 100 would be occupied with the oufflowing oil. Separation between oil and coolant would then be provided merely by the beads 98, which also separate the inflowing coolant from the outflowing coolant in the chambers 94, and 96 respectively. As an option, each of the intermediate plates 80 can further include embossed knobs 108 that are bonded to the embossed knobs 108 on the opposite plate 80.

Figure 15:
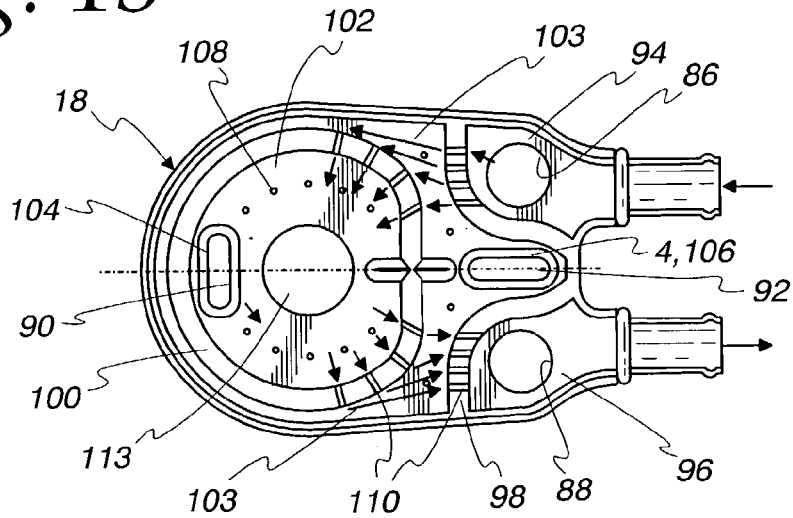
FIG. 15 is a view similar to FIG. 11 showing a modification to the intermediate plate pair of FIG. 10.

It should be noted that it is not always absolutely necessary that the bead 98 or the bead 100 would absolutely prevent the flow of coolant between the chambers 94, 96, 102, and 103. Indeed, in some applications it may be advantages to provide any individual bead 98, 100 or all of the beads 98, 100 with interruptions 110 that allow a metered or restricted flow of the coolant between the chambers 94, 96, 102, and 103, as shown by the arrows in FIG. 15. The interruptions 110 represents small openings after assembly of the intermediate plates 80, through which a restricted or limited flow of the coolant can occur, as indicated by the small arrows in FIG. 14. Because the plates 80 are mirror images of each other, two opposite interruptions each form one opening. Obviously in the construction of FIG. 15, the continuous edges 104, 106 act as barriers that separate the coolant from the oil.

It should also be understood that while embossed features 98, 100, 104, and 106 are preferred, in some embodiments it may be advantages to replace these features by loose parts, such as rods and/or rings, that are inserted between the intermediate plates 80 and are later bonded, such as by soldering, to the intermediate plates 80.

Each of the intermediate plates 80 include a continuous outer flange or edge 112 around its outer perimeter that engages the continuous flange 112 on the opposite plate 80 and is abutted and bonded thereto to seal the interior of the intermediate plate pair 18 from the exterior of the intermediate plate pair 18. Additionally, each of the intermediate plates 80 includes an opening 113 that is aligned with the openings 52 to define the through hole 40, with each of the openings 113 being surrounded by a continuous flange 114 that is abutted and bonded to the continuous flange 114 on the other intermediate plate to seal the interior of the intermediate plate pair 18 from the exterior of the intermediate plate pair 18.

Figure 16:
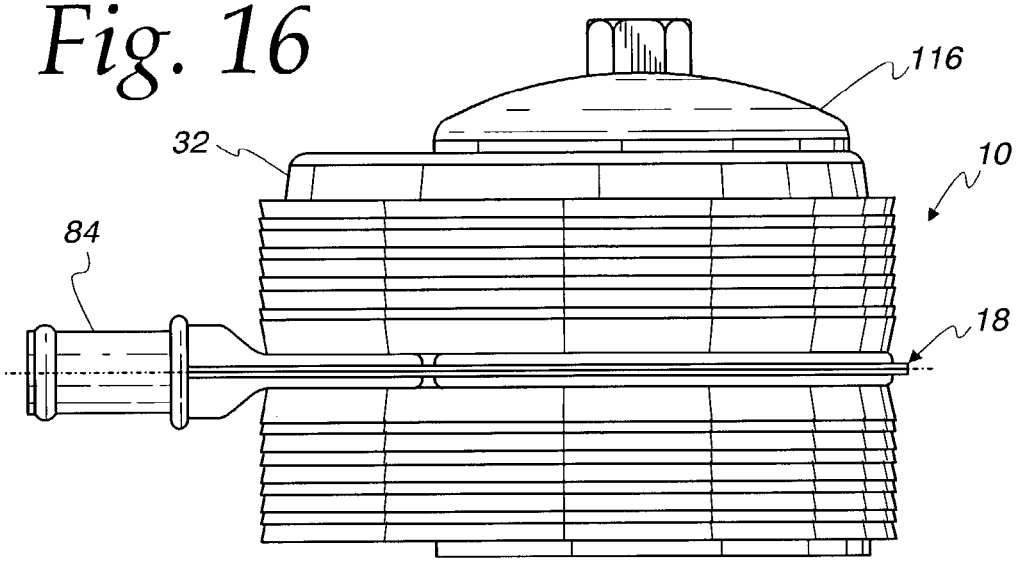
FIG. 16 is a view showing the heat exchanger of FIG. 1 with a dome assembled thereon.
Figure 17:
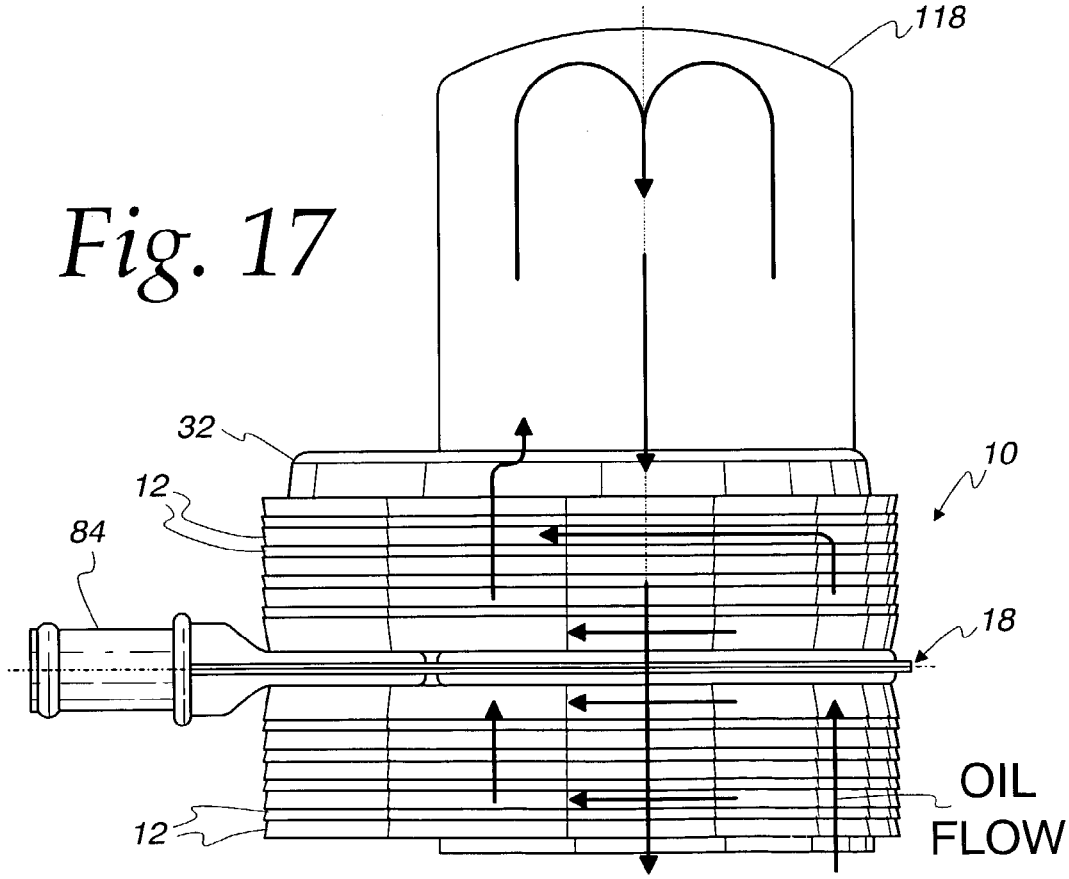
FIG. 17 is a figure showing the heat exchanger of FIG. 1 with a oil filter assembled thereon.

FIG. 16 shows one specific application example wherein a so called bell or cap 116 is assembled to the top of the heat exchanger 10 rather than an oil filter. In this regard, the bell 116 could also completely replace the baffle plate 32.

FIG. 16 shows the heat exchanger 10 with an oil filter 118 assembled thereon. The oil flow is illustrated in FIG. 16 by the heavy arrows.

Figure 18:
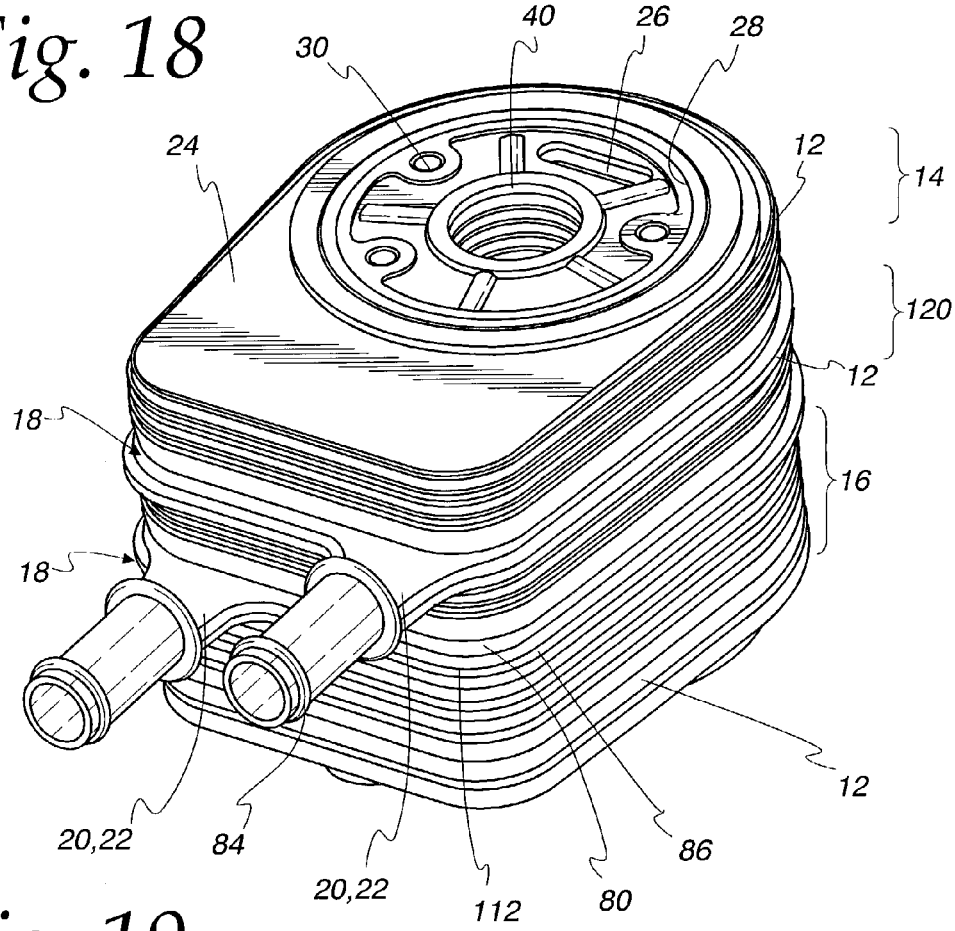
FIG. 18 is a prospective view of another heat exchanger embodying the present invention.
Figure 19:
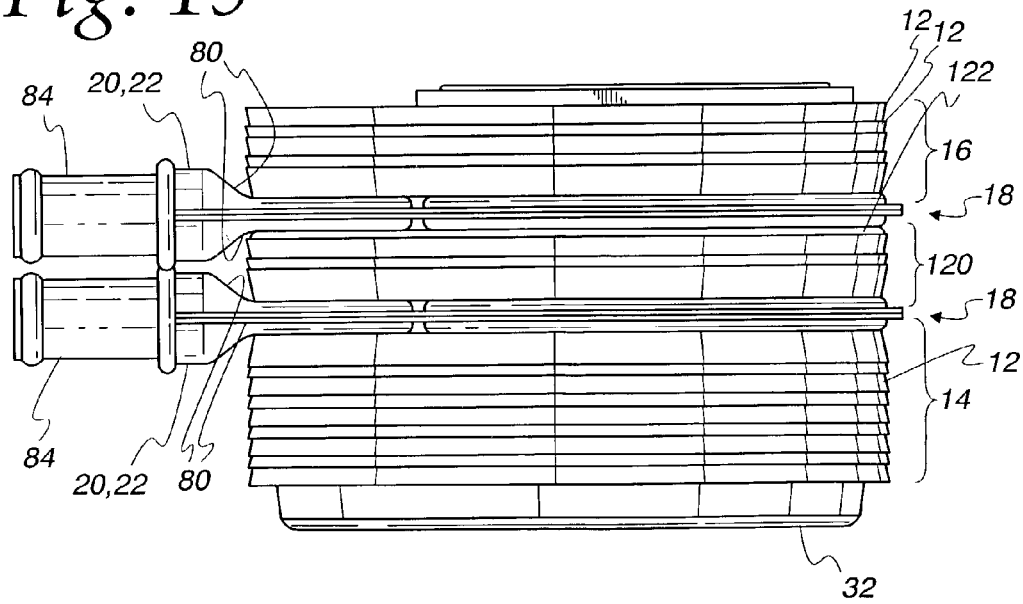
FIG. 19 is a side view of the heat exchanger of FIG. 18.
Figure 20:
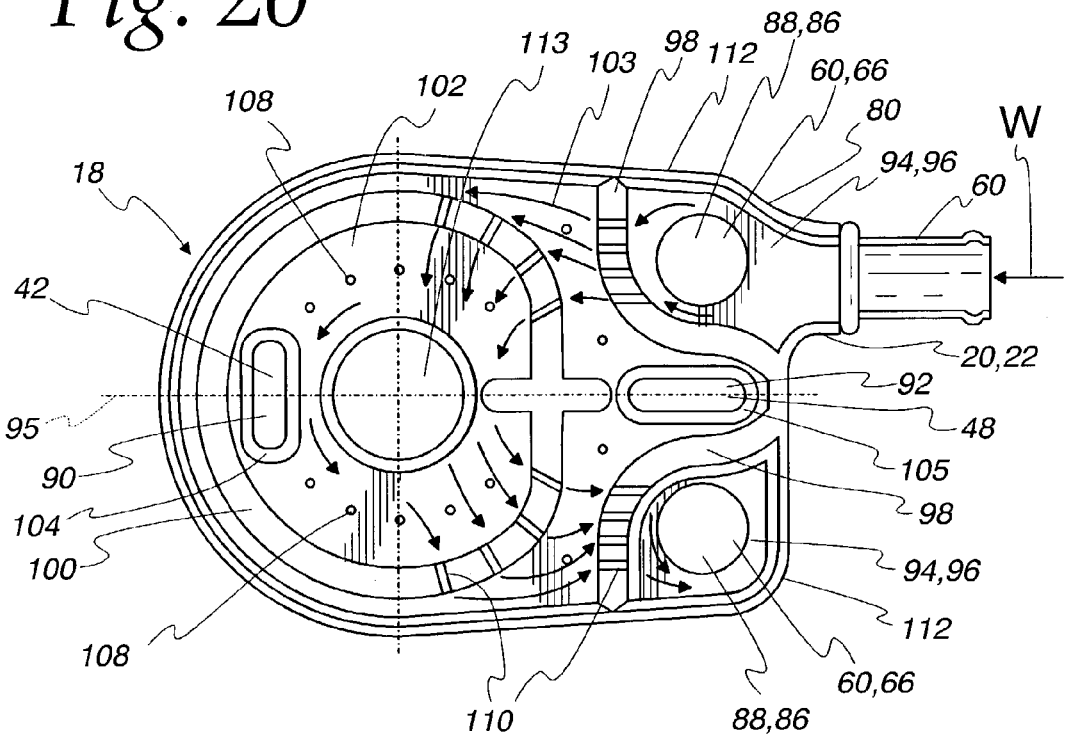
FIG. 20 is a top view of an intermediate plate pair of the heat exchanger of FIG. 18.

FIGS. 18, 19, and 20 illustrate yet another embodiment of the heat exchanger 10 wherein two intermediate plate pairs 18 are provided, with each intermediate plate pair having only a single one of the inlet or outlet ports 20, 22. In this construction the heat exchange plates 12 are arrange to provide an additional stack 120 that is provided between the intermediate plate pairs 18. In this regard an insert plate 122 is sandwiched between the additional stack 120 and the upper most intermediate plate pair 18 to balance the transition between the stack 118 and the intermediate plate pair 18 by balancing out the edge height and trough depth of the uppermost heat exchange plate 12 in the stack 120, as best seen in FIG. 19. Thus, as oriented in FIG. 19, the lowermost intermediate plate 80 of the uppermost intermediate plate pair 18 is not directly connected to the adjacent heat exchange plate 12, but rather is indirectly connected thereto by the insert plate 122. FIG. 20 is intended to show each of the intermediate plate pairs in general. It shows that only one of the ports 20, 22 is provided in the intermediate plate pair, with the continuous flange 112 sealing the portions of the intermediate plate pair 18 where the other port 20, 22 was positioned in the previously described embodiments. Thus, the intermediate plates 80 of the intermediate plate pair 18 in FIG. 20 are mirrore images of each other. In all other respect, the intermediate plates are identical to those of the previously described embodiments, including the option of providing the interruptions 110.

Figure 21:
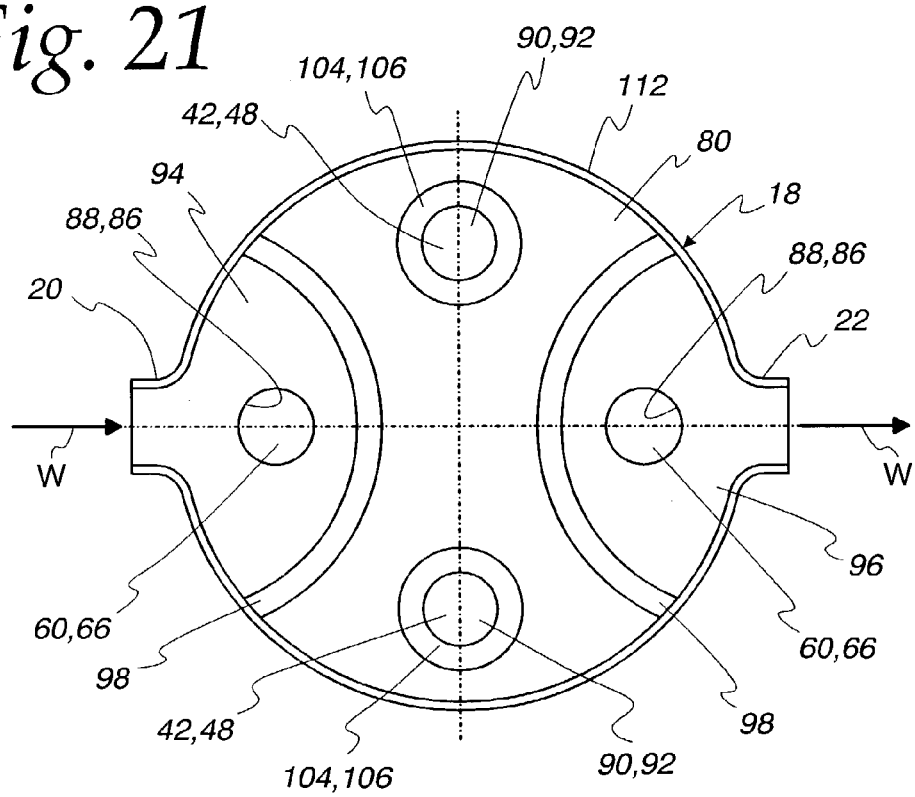
FIG. 21 is a somewhat diagrammatic top view of an intermediate plate pair of yet another heat exchanger embodying the present invention.

FIG. 21 shows the intermediate plate pair 18 of another embodiment of the heat exchanger 10. In this embodiment, the heat exchanger 10 has a rotationally symmetrical shape with no central through hole 40. With the exception of the intermediate plate pair 18, such heat exchangers are known in the prior art and can be derived, for example, from DE 198 02 012 A1. In this example, the inlet port 20 is located 180° away from the outlet port 22 and there is no bead 100 or chamber 102. In another practical example (not shown) similar to that shown in FIG. 21, the angle between the inlet port 20 and the outlet port 22 is roughly 90°. Thus, it should be appreciated that the inlet and outlet ports 20 and 22 can therefor be positioned as desired relative to each other depending on the requirements of each particular application by appropriate positioning of the separation beads 98 and the openings 90, 92, 86, and 88 so that they align with the location of their respective manifolds 42, 48,60 and 66.

As another alternative, it is conceivable in some applications not to use the laterally extending ports 20, 22 for the same fluid, but instead to use one of the ports 20,22 as an inlet or outlet for one fluid and the other port 20,22 as an inlet or outlet for another fluid. This could make it necessary to employ intermediate plates 80 that are not identical or mirror images of each other. It should also be understood that there may be other applications where more than two intermediate plate pairs 18 are desired.

We claim:

1. A housing-less plate heat exchanger for transferring heat between at least a first fluid and a second fluid and including an first inlet manifold to distribute the first fluid, a first outlet manifold to collect the first fluid, a second inlet manifold to distribute the second fluid, and a second outlet manifold to collect the second fluid, the heat exchanger comprising: a plurality of heat exchange plates stacked to enclose flow channels for the first and second fluids between the plates, each of the heat exchange plates including a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the heat exchange plates arranged into a first stack of the heat exchange plates and a second stack of the heat exchange plates; a first intermediate plate pair sandwiched between the first and second stack of heat exchange plates and including a first fluid port extending laterally from the heat exchanger to transfer the first fluid between the heat exchanger and a device other than the heat exchanger, each plate of the intermediate plate pair comprising a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the intermediate plates joined to enclose a first chamber, the first chamber opening to the first fluid port and to one of the first fluid inlet and outlet manifolds to direct the first fluid between the first fluid port and the one of the first fluid inlet and outlet manifolds; and a barrier located between the plates of the intermediate plate pair to separate the first fluid from the second fluid wherein the barrier comprises embossed features formed on the intermediate plates.

2. A housing-less plate heat exchanger for transferring heat between at least a first fluid and a second fluid and including an first inlet manifold to distribute the first fluid, a first outlet manifold to collect the first fluid, a second inlet manifold to distribute the second fluid, and a second outlet manifold to collect the second fluid, the heat exchanger comprising: a plurality of heat exchange plates stacked to enclose flow channels for the first and second fluids between the plates, each of the heat exchange plates including a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the heat exchange plates arranged into a first stack of the heat exchange plates and a second stack of the heat exchange plates; a first intermediate plate pair sandwiched between the first and second stack of heat exchange plates and including a first fluid port extending laterally from the heat exchanger to transfer the first fluid between the heat exchanger and a device other than the heat exchanger, each plate of the intermediate plate pair comprising a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the intermediate plates joined to enclose a first chamber, the first chamber opening to the first fluid port and to one of the first fluid inlet and outlet manifolds to direct the first fluid between the first fluid port and the one of the first fluid inlet and outlet manifolds; and a barrier located between the plates of the intermediate plate pair to separate the first fluid from the second fluid wherein the intermediate plates are mirror images of each other.

3. The housing-less plate heat exchanger of claim 2 wherein the intermediate plates are identical.

4. A housing-less plate heat exchanger for transferring heat between at least a first fluid and a second fluid and including an first inlet manifold to distribute the first fluid, a first outlet manifold to collect the first fluid, a second inlet manifold to distribute the second fluid, and a second outlet manifold to collect the second fluid, the heat exchanger comprising: a plurality of heat exchange plates stacked to enclose flow channels for the first and second fluids between the plates, each of the heat exchange plates including a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the intermediate plates joined to enclose a first chamber, the first chamber opening to the first fluid port and to one of the first fluid inlet and outlet manifolds to direct the first fluid between the first fluid port and the one of the first fluid inlet and outlet manifolds; and a barrier located between the plates of the intermediate plate pair to separate the first fluid from the second fluid wherein each of the intermediate plates comprises a laterally extending semi-cylindrical feature that mates with the semi-cylindrical feature of the other intermediate plate to form a cylindrical shape for the first inlet port.

5. A housing-less plate heat exchanger for transferring heat between at least a first fluid and a second fluid and including an first inlet manifold to distribute the first fluid, a first outlet manifold to collect the first fluid, a second inlet manifold to distribute the second fluid, and a second outlet manifold to collect the second fluid, the heat exchanger comprising: a plurality of heat exchange plates stacked to enclose flow channels for the first and second fluids between the plates, each of the heat exchange plates including a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the heat exchange plates arranged into a first stack of the heat exchange plates and a second stack of the heat exchange plates; a first intermediate plate pair sandwiched between the first and second stack of heat exchange plates and including a first fluid port extending laterally from the heat exchanger to transfer the first fluid between the heat exchanger and a device other than the heat exchanger, each plate of the intermediate plate pair comprising a first inlet opening aligned with the first inlet opening of an adjacent heat exchange plate to define the first inlet manifold, a first outlet opening aligned with the first outlet opening of an adjacent heat exchange plate to define the first outlet manifold, a second inlet opening aligned with the second inlet opening of an adjacent heat exchange plate to define the second inlet manifold, and a second outlet opening aligned with the second outlet opening of an adjacent heat exchange plate to define the second outlet manifold, the intermediate plates joined to enclose a first chamber, the first chamber opening to the first fluid port and to one of the first fluid inlet and outlet manifolds to direct the first fluid between the first fluid port and the one of the first fluid inlet and outlet manifolds; and a barrier located between the plates of the intermediate plate pair to separate the first fluid from the second fluid, wherein each of the heat exchange plates has a continuous outer rim that can be nested in the continuous outer rim of an adjacent heat exchange plate, and the rims of each of the first and second stacks turn away from the intermediate plate pair.

* * * * *